US010167108B2

(12) United States Patent
Nugent et al.

(10) Patent No.: US 10,167,108 B2
(45) Date of Patent: Jan. 1, 2019

(54) ADJUSTABLE ATTACHMENT CLIP FOR A SHIPPING CRATE

(71) Applicant: Great Northern Corporation, Appleton, WI (US)

(72) Inventors: Corey Nugent, Appleton, WI (US); Fred Sklenar, Eau Claire, WI (US)

(73) Assignee: Great Northern Corporation, Appleton, WI (US)

( * ) Notice: Subject to any disclaimer, the term of this patent is extended or adjusted under 35 U.S.C. 154(b) by 0 days.

(21) Appl. No.: 15/803,237

(22) Filed: Nov. 3, 2017

(65) Prior Publication Data

US 2018/0127144 A1 May 10, 2018

Related U.S. Application Data

(60) Provisional application No. 62/417,696, filed on Nov. 4, 2016.

(51) Int. Cl.
*B65D 6/26* (2006.01)
*B65D 6/02* (2006.01)
(Continued)

(52) U.S. Cl.
CPC ..... *B65D 9/22* (2013.01); *B65D 9/06* (2013.01); *B65D 9/34* (2013.01); *B65D 11/20* (2013.01);
(Continued)

(58) Field of Classification Search
CPC ..... B65D 15/24; B65D 15/00; B65D 9/24; B65D 9/22; B65D 9/12; B65D 9/06; B65D 9/34; B65D 9/32; B65D 13/04; B65D 11/20; B65D 11/1866; B65D 11/1873; B65D 90/08; B65D 90/02
(Continued)

(56) References Cited

U.S. PATENT DOCUMENTS 3,989,157 A * 11/1976 Veenema ..... B65D 9/34 220/4.28
4,002,261 A * 1/1977 Litchfield ..... F16B 12/02 220/4.33
(Continued)

FOREIGN PATENT DOCUMENTS

GB 594543 A * 11/1947 ..... B65D 9/34
WO WO 9401333 A1 * 1/1994 ..... B65D 9/22

*Primary Examiner* — Robert J Hicks
(74) *Attorney, Agent, or Firm* — Andrus Intellectual Property Law, LLP

(57) ABSTRACT

A shipping crate formed from connected V-shaped corner board sections. The shipping crate includes top and bottom frames each formed from sections of corner board. A series of attachment clips are used to connect the top and bottom frames to corner uprights and one or more cross supports, where the corner uprights and cross supports are formed from sections of corner board. The attachment clip includes a center wall and front and back walls that each combine with the center wall to form first and second receiving cavities. The first and second receiving cavities are each able to receive one leg of a corner board section. A guard wall is formed on the attachment clip and spaced from the back wall to define a connector cavity. The connector cavity receives ends of a series of connectors used to join the corner board sections within the attachment clip.

18 Claims, 6 Drawing Sheets

(51) Int. Cl.
*B65D 6/34* (2006.01)
*B65D 6/00* (2006.01)

(52) U.S. Cl.
CPC ..... *B65D 13/04* (2013.01); *B65D 2313/00* (2013.01)

(58) Field of Classification Search
USPC .... 220/4.33, 4.34, 4.28, 622, 615, 610, 693, 220/692, 677; 217/43 R, 45, 42, 36, 13, 217/12 R, 5, 65, 66, 67; 206/600; 24/458, 457, 455, 570, 1; 403/397
See application file for complete search history.

(56) References Cited

U.S. PATENT DOCUMENTS 4,593,831 A * 6/1986 Clive-Smith ..... B65D 90/0026 220/1.5
4,673,087 A * 6/1987 Webb ..... B65D 11/1873 16/225
5,638,973 A * 6/1997 Dewey ..... B65D 11/1873 206/509
7,159,345 B2 * 1/2007 Hunt ..... B65D 5/4283 108/55.1

* cited by examiner

ADJUSTABLE ATTACHMENT CLIP FOR A SHIPPING CRATE

CROSS-REFERENCE TO RELATED APPLICATION

The present application is based on and claims priority to U.S. Provisional Patent Application Ser. No. 62/417,696 filed on Nov. 4, 2016, the disclosure of which is incorporated herein by reference.

BACKGROUND

The present disclosure generally relates to a shipping crate formed from sections of corner board. More specifically, the present disclosure relates to a shipping crate that can be formed from individual sections of V-shaped corner board and can be assembled and connected to form the shipping crate in a desired size and shape.

SUMMARY

The present disclosure relates to a shipping crate that can be assembled from multiple sections of V-shaped corner board. The shipping crate utilizes a series of attachment clips to join sections of corner board in a desired shape to define the shipping crate.

Each of the attachment clips includes a center wall and first and second walls that are connected to opposite ends of the center wall. The first and second walls extend perpendicular to the center wall. The first wall is connected to a back wall and the second wall is connected to a front wall. The front and back walls combine with the center wall to create first and second receiving cavities each sized to receive separate portions of two sections of corner board. Once the separate portions of corner board are received within the receiving cavities of the attachment clip, a series of connectors are used to join the corner board sections within the attachment clip. In one embodiment, the front wall of the attachment clip includes a series of pre-formed connector holes that are each sized to receive one or more connectors, such as threaded screws. The connectors extend through the front wall, center wall and back wall of the attachment clip to secure the corner board sections together. The corner board sections can be angled relative to each other and secured to each other by the attachment clips and connectors.

When the connectors are received within the attachment clip, a guard wall formed as part of the attachment clip shields the sharp, pointed ends of the connectors from contact with persons and articles being shipped during use of the shipping crate.

Various other features, objects and advantages of the invention will be made apparent from the following description taken together with the drawings.

DETAILED DESCRIPTION

Figure 1:
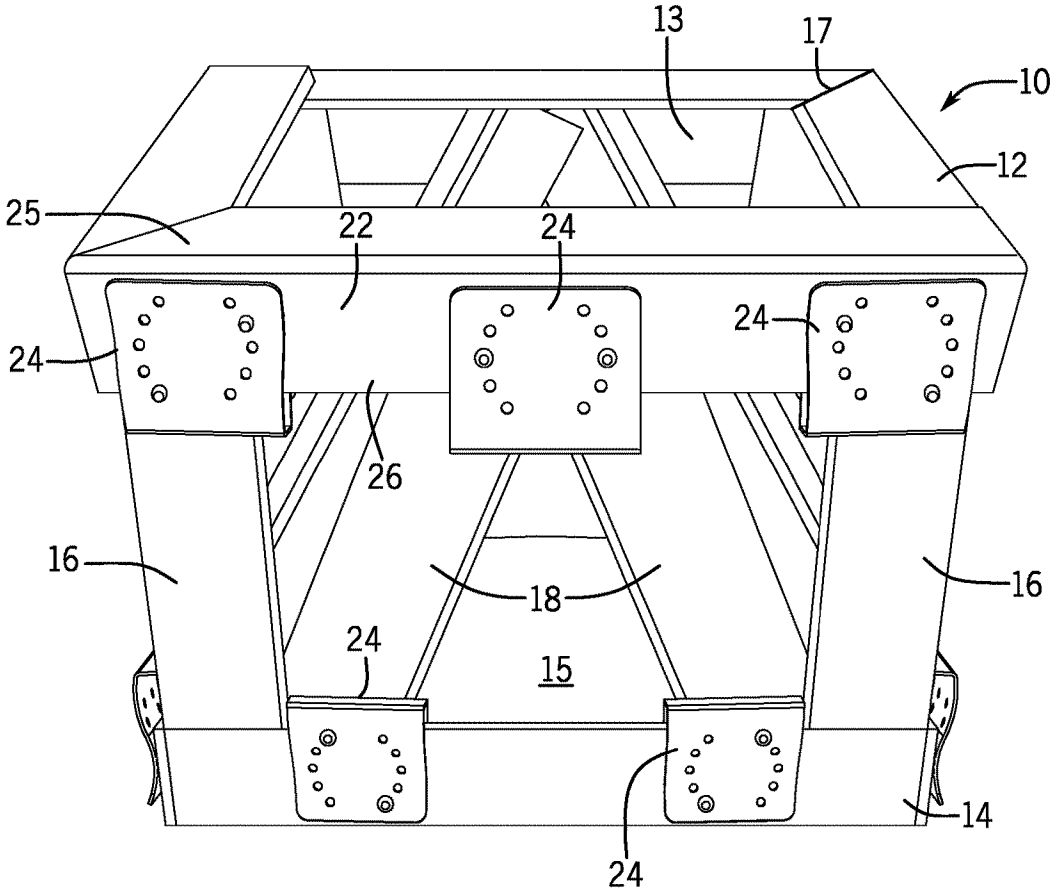
FIG. 1 is a perspective view of a shipping crate formed from V-shaped corner board utilizing the attachment clip of the present disclosure.

FIG. 1 illustrates a shipping crate 10 constructed in accordance with one embodiment of the present disclosure. The shipping crate 10 is sized to completely protect an article to be shipped, such as furniture, appliance, electronics or other types of products that need protection on each side as well as on the to and bottom. The embodiment shown in FIG. 1 is meant for illustrative purposes since the size and configuration of the shipping container can vary depending upon the article being shipped.

As shown in FIG. 1, the shipping crate 10 includes a top frame 12 and a bottom frame 14 that are supported between four corner uprights 16. In the embodiment shown, the top frame 12 includes an open top 13 and the bottom frame 14 includes an open bottom 15. However, it is contemplated that both the open top 13 and the open bottom 15 could be covered by a flat sheet of material, such as paperboard. The top frame 12 and the bottom frame 14 are formed from sections of corner board 11 joined at overlapping or mitered corners 17. Each section of corner board that forms one of the frames has a V-shaped cross section including first leg 25 and a second leg 26.

In the embodiment shown, a series of angled cross supports 18 are included to provide additional support for the shipping container. Although the angled cross supports 18 are shown, it is contemplated that the angled cross supports 18 may not be needed in smaller application or that additional angled cross supports 18 may be needed in larger applications.

In the embodiment shown, the top frame 12, the bottom frame 14, the corner uprights 16 and the cross supports 18 are all formed from sections of V-shaped corner board formed from a paper board material. Other materials could replace paper board, such as plastic or layered corrugated.

As illustrated in FIG. 1, each of the cross supports 18 are joined to the top frame 12 and the bottom frame 14 by a series of attachment clips 24. Each of the attachment clips 24 provides a point of connection between the V-shaped corner board sections used to create the shipping crate 10.

Figure 2:
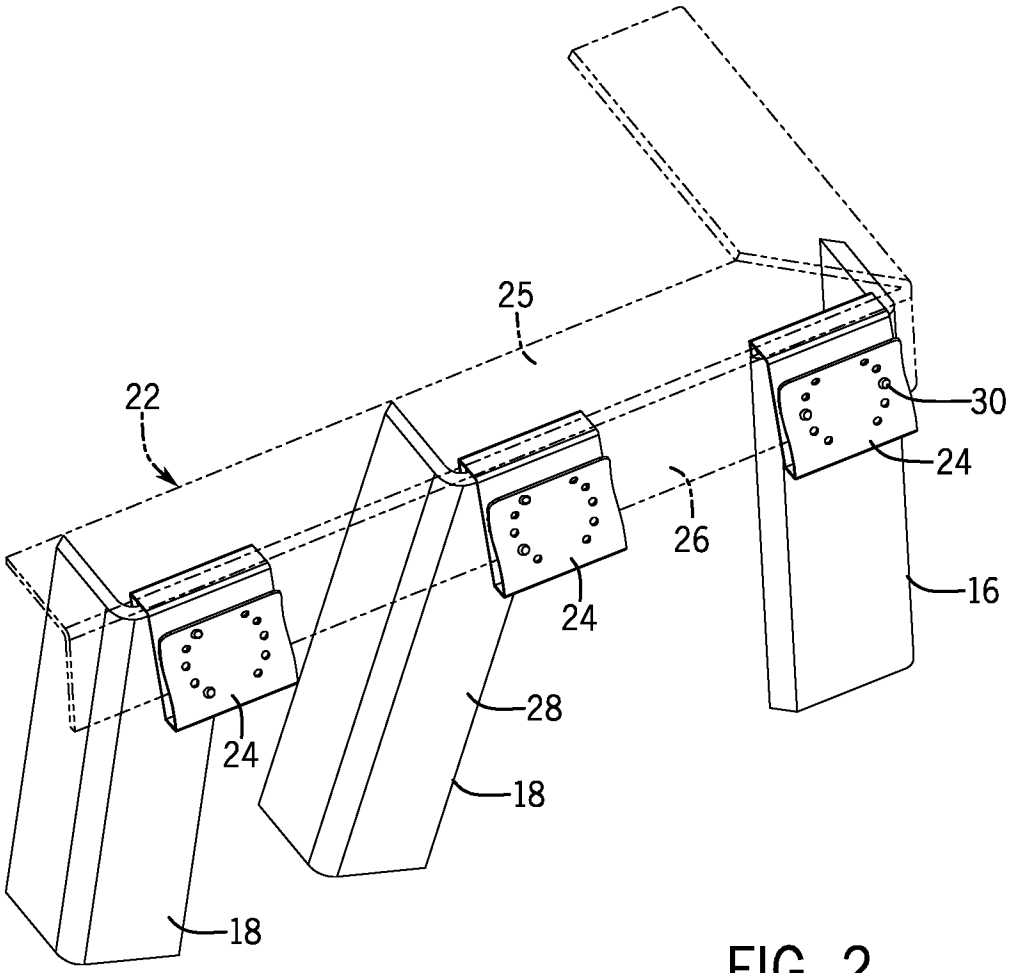
FIG. 2 is view of three attachment clips used to join the corner board sections used to form the shipping crate.

FIG. 2 further illustrates the position and orientation of the attachment clips 24 used to attach the two separate cross supports 18 and the corner upright 16 to the second leg 26 of the front support 22 that forms part of the top frame 12. Specifically, the second leg 26 of the front support 22 is joined to the first leg 28 of the cross supports 18. In the embodiment illustrated, each of the attachment clips 24 receives a pair of threaded connectors 30 that extend through the attachment clip 24, the first leg 28 of the cross support 18 and the second leg 26 of the front support 22. The angle of the cross supports 18 can be selected during assembly and the orientation of the cross support 18 relative to the top frame is secured by one or more connectors.

Figure 3:
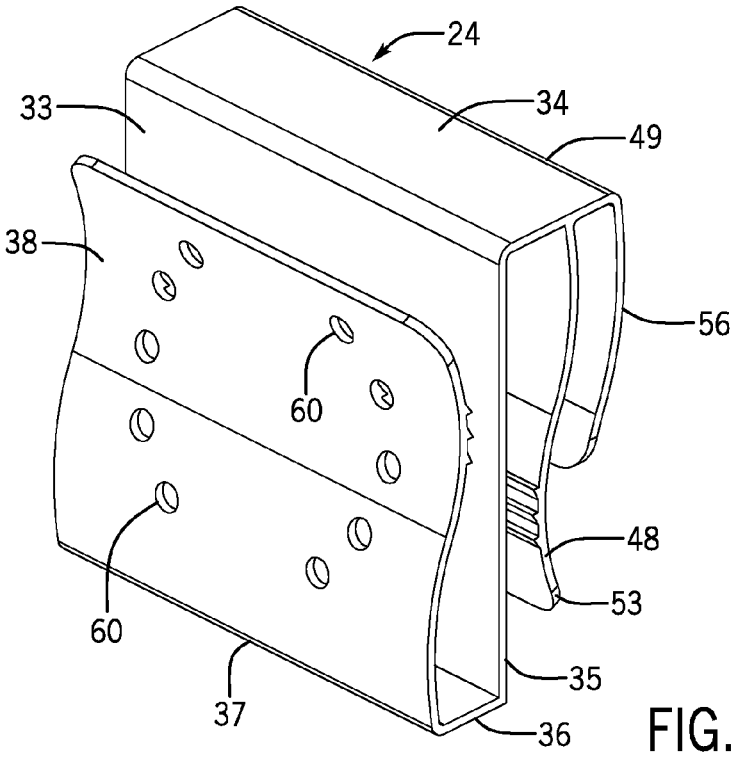
FIG. 3 is a front perspective view of the attachment clip.
Figure 4:
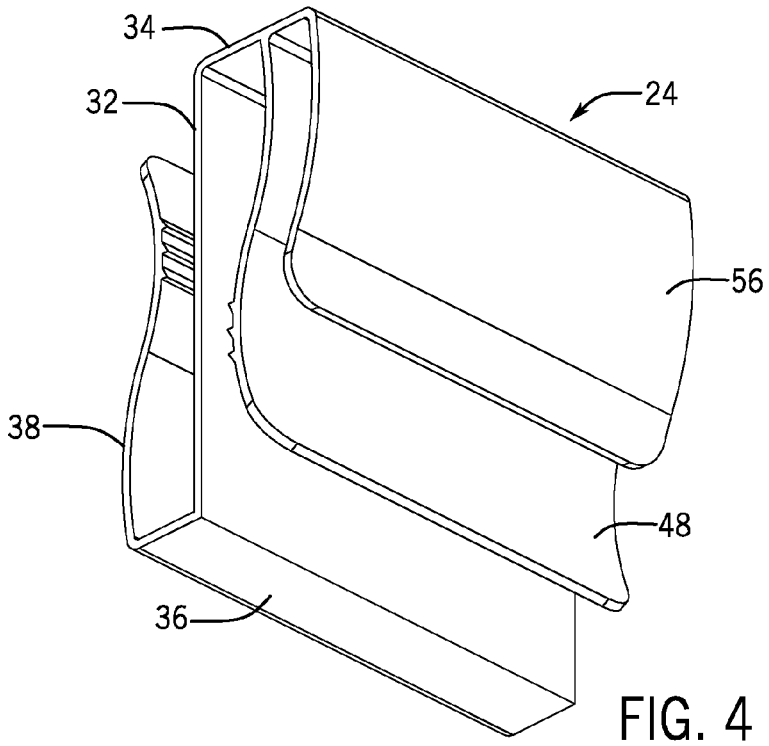
FIG. 4 is a rear perspective view of the attachment clip.

FIGS. 3-9 illustrate the attachment clip 24 constructed in accordance with the present disclosure. Referring first to FIGS. 3 and 4, front and back perspective views of the attachment clip 24 are shown for a first embodiment of the present disclosure. The attachment clip 24 is preferably formed from a plastic material, although other types of materials are contemplated as being within the scope of the present disclosure. In the embodiment shown, the attachment clip 24 is an extruded plastic component having the shape illustrated and cut to the desired width. However, it is contemplated that the attachment clip could be molded.

Figure 6:
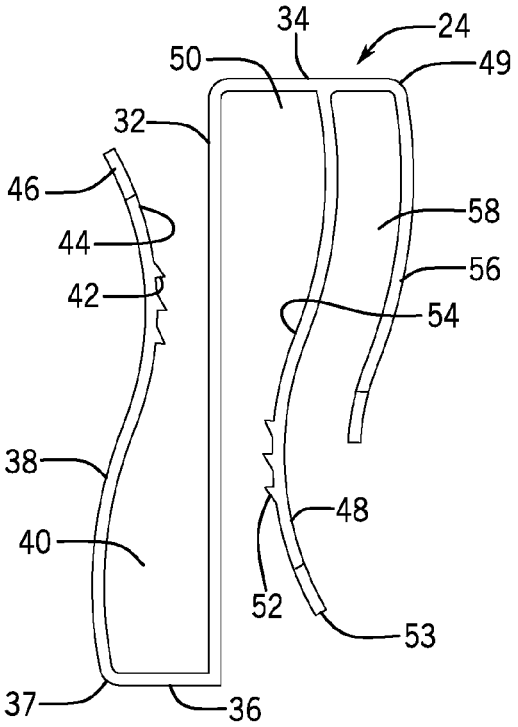
FIG. 6 is a side plan view of the attachment clip.
Figure 8:
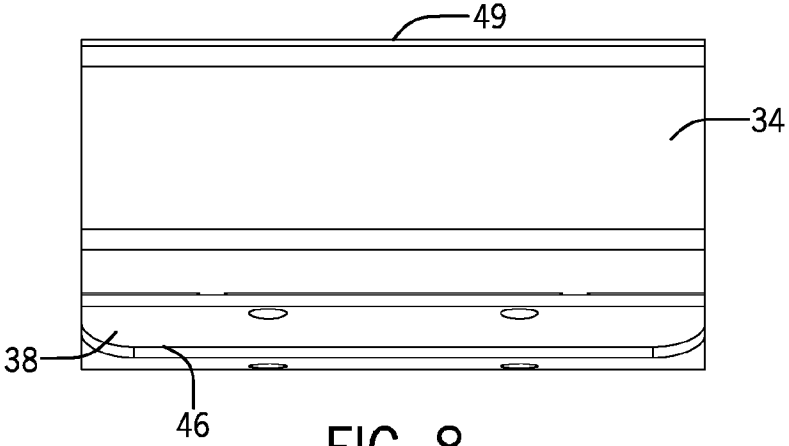
FIG. 8 is a top plan view of the attachment clip.
Figure 9:
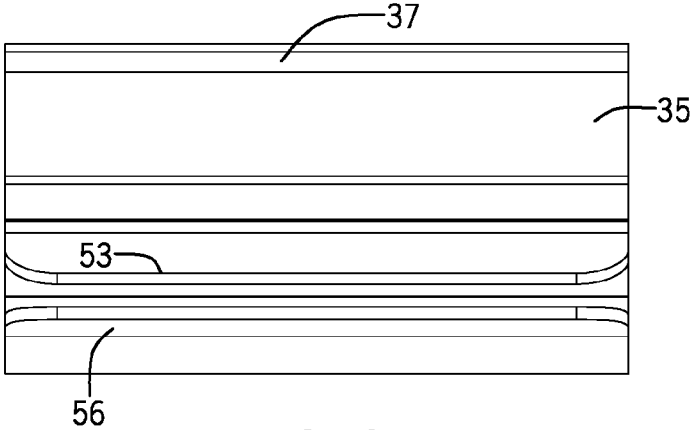
FIG. 9 is bottom plan view of the attachment clip.
Figure 7:
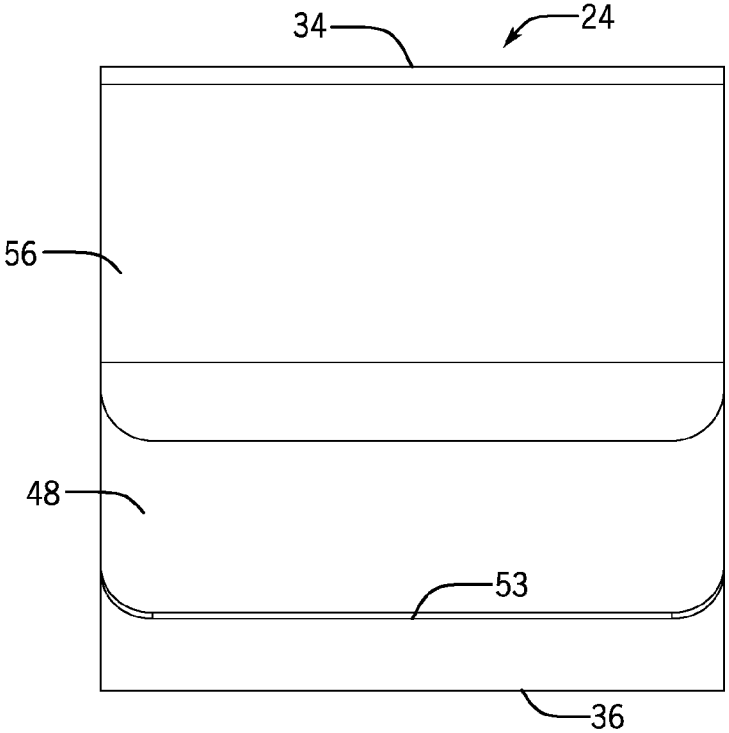
FIG. 7 is a back plan view of the attachment clip.

The attachment clip 24 includes a center wall 32 that extends between a first end 33 and a second end 35. The first end 33 is joined to a first wall 34 and the second end 35 is joined to a second wall 36. The first and second walls 34, 36 are each positioned and connected to the center wall 32 such that the first and second walls 34, 36 each are perpendicular to the center wall 32 and extend in opposite directions from the center wall 32, as can be illustrated in the side view of FIG. 6. As shown in FIG. 6, the first wall 34 has a greater length compared to the second wall 36.

As can be seen in FIGS. 3 and 6, a flexible front wall 38 extends in a generally perpendicular direction from an outer edge 37 of the second wall 36 to create a first receiving cavity 40 between the front wall 38 and the center wall 32. In the embodiment illustrated, the front wall 38 includes a series of ridges 42 formed along an inner surface 44. The series of spaced ridges 42 are used to grip a section of corner board when the section of corner board is received within the first receiving cavity 40. The front wall 38 is shaped such that the outer edge 46 extends away from the center wall 32 and the material of the attachment clip 24 allows the front wall 38 to flex away from the center wall 32 as the first receiving cavity 40 receives a portion of the corner board.

In addition to the front wall 38, the attachment clip 24 includes a back wall 48 that extends in a generally perpendicular direction relative to the first wall 34. The back wall 48 is connected to the first wall 34 at a location between the center wall 32 and an outer edge 49 of the first wall 34 to form a second receiving cavity 50 between the back wall 48 and the center wall 32. The sized of the second receiving cavity 50 is similar to the size of the first receiving cavity 40 such that each of the receiving cavities can receive a section of corner board. In the embodiment illustrated, the back wall 48 includes a similar series of ridges 52 formed on the inner surface 54. The ridges 52 are used to grip a section of corner board when the section of corner board is received within the second receiving cavity 50. The back wall 48 is shaped such that an outer edge 53 extends away from the center wall 32 and the material of the attachment clip 24 allows the back wall 48 to flex away from the center wall 32 to receive a portion of the corner board.

The attachment clip 24 further includes a guard wall 56 that extends in a generally perpendicular direction from the outer edge 49 of the first wall 34. The guard wall 56 is spaced from the back wall 48 to create a connector cavity 58 between the guard wall 56 and the outer surface of the back wall 48. The connector cavity 58 receives the outer ends of the connectors 30 when the connectors 30 are used to secure the attachment clip in the manner shown in FIG. 2.

Figure 5:
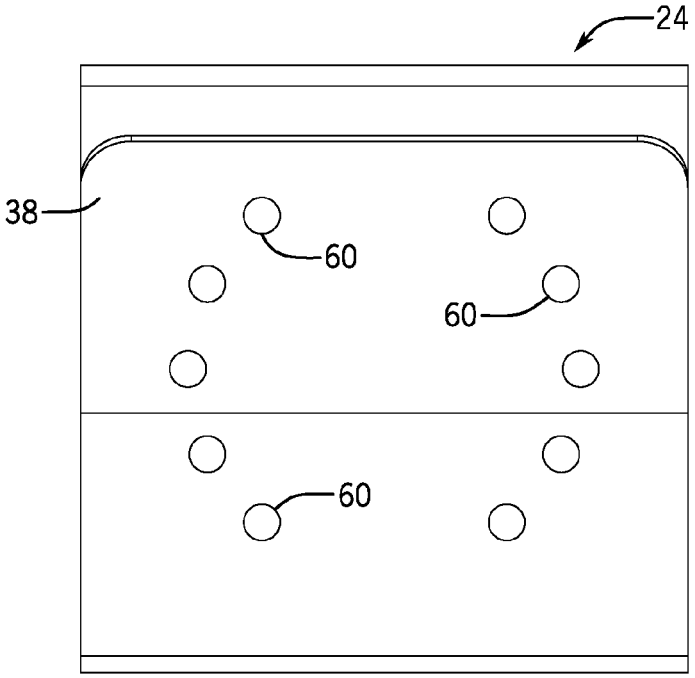
FIG. 5 is a front plan view of the attachment clip.

As can best be seen in FIGS. 3 and 5, in one embodiment of the present disclosure, the front surface of the front wall 38 includes a series of pre-formed connector holes 60 that are each sized to receive a connector. The orientation of the connector holes 60 define a series of preselected locations for the connectors used to join the attachment clip 24 to the corner board sections. Although a specific orientation of the connector holes 60 is shown in FIGS. 3 and 5, it is contemplated that other orientations could be utilized while operating within the scope of the present disclosure. In addition, it is contemplated that the connector holes 60 could be eliminated in other embodiments of the disclosure and connectors could simply be drilled through the front wall 38 at user selected locations.

Figure 10:
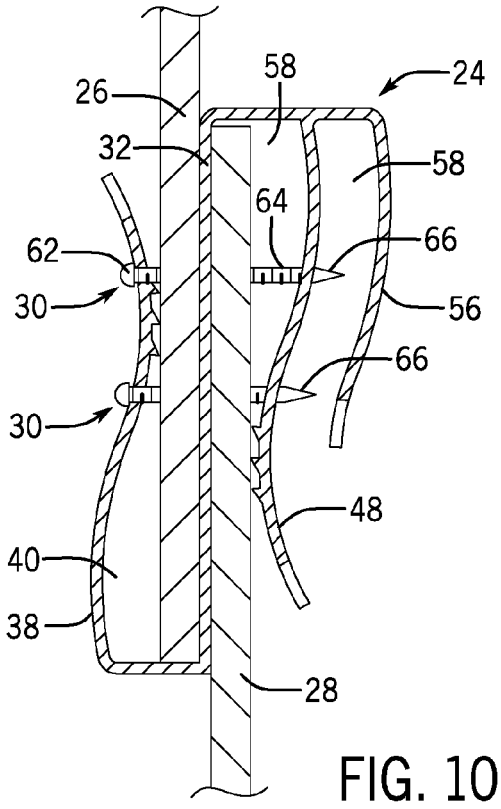
FIG. 10 is a partial section view illustrating the use of the attachment clip to join two portions of corner board.

FIG. 10 is a side view illustrating the use of the attachment clip 24 to join the first second 26 of the front support to the first leg 28 of the cross support. As illustrated, the second leg 26 is received within the first receiving cavity 40 while the first leg 28 is received within the second receiving cavity 50. A pair of connectors 30 is used to secure the attachment clip 24 to the two separate corner board sections. Specifically, each of the two connectors includes a head 62 and a threaded shaft 64. The threaded shaft 64 extends through the pre-drilled connector holes formed in the front wall 38. The shaft 64 extends through the first leg 26 and into and through the center wall 32. The threaded shaft 64 extends through the first leg 28 and into and through the back wall 48. As illustrated in FIG. 10, the length of the connector 30 is selected such that the pointed end 66 of each connector is received within the connector cavity 58. The guard wall 56 covers the pointed ends 66 to prevent the sharp, pointed ends from being contacted by a user after the shipping crate has been assembled. The length of each of the connectors 30 is selected to be greater that the distance from the front wall 38 to the back wall 48 but less than the distance from the front wall 38 to the guard wall 56.

Referring back to FIG. 2, the individual connectors 30 can be inserted through different combinations of the connector holes 60 depending upon the angled orientation of the cross supports 18 relative to the front support 22. The connector holes 60, as best shown in FIG. 5, are oriented in the shape of an arc to provide different points of attachment on either side of a center line extending through the attachment clip 24. Although the embodiment shown in FIG. 2 utilizes two connectors 30 to join each attachment clip to sections of V-shaped corner board, it is contemplated that an additional number of connectors could be utilized depending upon the strength requirements for the shipping crate.

Figure 11:
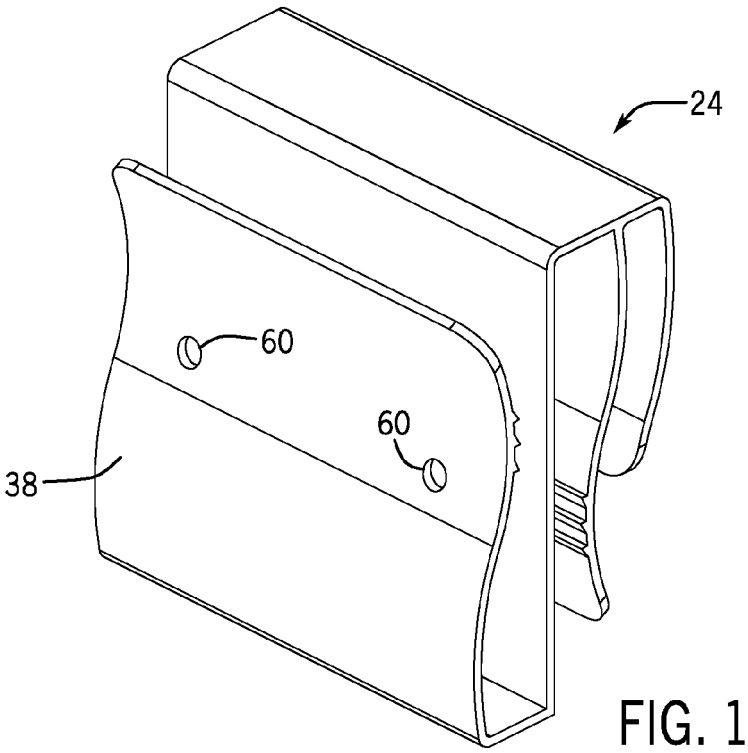
FIG. 11 is a front perspective view of an alternate embodiment of the attachment clip.

FIG. 11 illustrates another embodiment of the attachment clip 24 in which only two connector holes are included in the front wall 38. Alternatively, the connector holes 60 could be entirely eliminated and the connectors could include sharp outer ends that would penetrate the plastic material used to form the attachment clip 24 at the desired location for the connectors.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. An attachment clip comprising:

a center wall extending between a first end and a second end;

a first wall connected to the first end and extending perpendicular to the center wall;

a second wall connected to the second end and extending perpendicular to the center wall;

a front wall connected to the second wall and extending from the second wall to form a first receiving cavity between the front wall and the center wall;

a back wall connected to the first wall and extending from the first wall to form a second receiving cavity between the back wall and the center wall; and a guard wall connected to the first wall and extending from the first wall, wherein the guard wall is spaced from the back wall to define a connector cavity.

2. The attachment clip of claim 1 wherein the back wall has a first length and the guard wall has a second length less than the first length.

3. The attachment clip of claim 1 wherein both the front wall and the back wall include an inner surface having a series of ridges.

4. The attachment clip of claim 1 wherein the center wall, first wall, second wall, front wall and back wall are integrally formed from a plastic material.

5. An attachment clip comprising:

a center wall extending between a first end and a second end;

a first wall connected to the first end and extending perpendicular to the center wall, wherein a plurality of connector holes are formed in the front wall;

a second wall connected to the second end and extending perpendicular to the center wall;

a front wall connected to the second wall and extending from the second wall to form a first receiving cavity between the front wall and the center wall; and a back wall connected to the first wall and extending from the first wall to form a second receiving cavity between the back wall and the center wall.

6. The attachment clip of claim 5 wherein the plurality of connector holes are spaced along an arc.

7. An attachment clip assembly for joining a first structural member to a second structural member, the attachment clip assembly comprising:

a center wall extending between a first end and a second end;

a first wall connected to the first end and extending perpendicular to the center wall;

a second wall connected to the second end and extending perpendicular to the center wall;

a front wall connected to the second wall and extending from the second wall to form a first receiving cavity between the front wall and the center wall, the front wall including at least a pair of connector holes;

a back wall connected to the first wall and extending from the first wall to form a second receiving cavity between the back wall and the center wall;

a guard wall connected to the first wall and extending from the first wall, wherein the guard wall is spaced from the back wall to define a connector cavity between the guard wall and the back wall; and at least a pair of connectors extending through the front wall, the center wall and the back wall.

8. The attachment clip assembly of claim 7 wherein each of the connectors has a length that is less than a distance from the front wall to the guard wall.

9. The attachment clip assembly of claim 7 wherein the back wall has a first length and the guard wall has a second length less than the first length.

10. The attachment clip assembly of claim 7 wherein both the front wall and the back wall include an inner surface having a series of ridges.

11. The attachment clip assembly of claim 7 wherein the plurality of connector holes are spaced along an arc.

12. The attachment clip assembly of claim 7 wherein the center wall, first wall, second wall, front wall and back wall are integrally formed from a plastic material.

13. A shipping crate, comprising:

a top frame;

a bottom frame;

a plurality of corner uprights extending between the top frame and the bottom frame at each of four corners;

at least one cross support extending between the top frame and the bottom frame; and an attachment clip configured to connect the cross support to either the top frame or the bottom frame, the attachment clip comprising:

a center wall extending between a first end and a second end;

a first wall connected to the first end and extending perpendicular to the center wall;

a second wall connected to the second end and extending perpendicular to the center wall;

a front wall connected to the second wall and extending from the second wall to form a first receiving cavity between the front wall and the center wall and sized to receive one of the top frame or the bottom frame;

a back wall connected to the first wall and extending from the first wall to form a second receiving cavity between the back wall and the center wall and sized to receive the cross support;

a guard wall connected to the first wall and extending from the first wall, wherein the guard wall is spaced from the back wall to define a receiving cavity between the guard wall and the back wall; and at least a pair of connectors extending through the front wall, the center wall and the back wall.

14. The shipping crate of claim 13 wherein the at least one cross support is formed from corner board having a V-shaped cross section including a first leg and a second leg.

15. The shipping crate of claim 14 wherein both the top frame and the bottom frame are formed from corner board having a V-shaped cross section including a first leg and a second leg.

16. The shipping crate of claim 14 wherein the first receiving cavity receives one of the first and second legs of the top frame or the bottom frame and the second receiving cavity receives one of the first and second legs of the at least one cross support.

17. The shipping crate of claim 13 wherein both the front wall and the back wall of the attachment clip include an inner surface having a series of ridges.

18. The shipping crate of claim 13 wherein the center wall, first wall, second wall, front wall and back wall are integrally molded from a plastic material.

* * * * *